US009881585B2

(12) United States Patent
Takahashi

(10) Patent No.: US 9,881,585 B2
(45) Date of Patent: Jan. 30, 2018

(54) DISPLAY DEVICE

(71) Applicant: Panasonic Liquid Crystal Display Co., Ltd., Hyogo (JP)

(72) Inventor: Kouji Takahashi, Chiba (JP)

(73) Assignee: PANASONIC LIQUID CRYSTAL DISPLAY CO., LTD., Hyogo (JP)

( * ) Notice: Subject to any disclaimer, the term of this patent is extended or adjusted under 35 U.S.C. 154(b) by 109 days.

(21) Appl. No.: 15/062,198

(22) Filed: Mar. 7, 2016

(65) Prior Publication Data

US 2017/0256231 A1 Sep. 7, 2017

(51) Int. Cl.
*G09G 5/00* (2006.01)

(52) U.S. Cl.
CPC ..... *G09G 5/008* (2013.01); *G09G 2310/0297* (2013.01); *G09G 2370/08* (2013.01)

(58) Field of Classification Search
CPC ..... G09G 2310/0297; G09G 2370/08; G09G 5/008
See application file for complete search history.

(56) References Cited

U.S. PATENT DOCUMENTS 6,937,233 B2 * 8/2005 Sakuma ..... G09G 3/3648 345/100
8,732,376 B2 * 5/2014 Saitoh ..... G06F 3/041 345/173
2006/0114217 A1 * 6/2006 Kim ..... G09G 3/20 345/100
2016/0133178 A1 * 5/2016 Oh ..... G09G 3/2092 345/208

FOREIGN PATENT DOCUMENTS

JP 2006-154835 A 6/2006

* cited by examiner

*Primary Examiner* — Ram Mistry
(74) *Attorney, Agent, or Firm* — Hubbs, Enatsky & Inoue PLLC

(57) ABSTRACT

In a display device, a timing controller is configured to transfer first display data and part of second display data to a first source driver via a first data transfer line at a high transfer frequency, and to transfer the remaining part of the second display data to a second source driver via the first data transfer line at a low transfer frequency, and the first source driver is configured to transfer the received part of the second display data to the second source driver via a second data transfer line.

9 Claims, 8 Drawing Sheets

DISPLAY DEVICE

BACKGROUND

1. Technical Field

The present application relates to a display device.

2. Description of the Related Art

In a display device in recent years, along with increase in size and resolution of the display device, the number of source drivers is increased, and a distance between a timing controller and the source driver is also increased (for example, Japanese Patent Application Laid-open No. 2006-154835). Further, in the above-mentioned display device, a data transfer speed is increased, and hence signal integrity of a display data signal between the timing controller and the source driver is deteriorated. As a result, there may arise a problem of reduction in display quality.

SUMMARY

In this case, data transfer between the timing controller and the source driver is required to be performed within one horizontal period. The one horizontal period is determined based on a frame rate and resolution. Further, the amount of data transferred by the timing controller to one source driver is determined based on the whole number of source drivers included in the display device. Further, the data transfer speed is determined based on the length of wiring between the timing controller and the source driver arranged at the farthest end. When the timing controller transfers data to each source driver uniformly at the above-mentioned determined data transfer speed, each source driver is required to complete the data transfer within the one horizontal period. Hitherto, when the data transfer is not completed within the one horizontal period, it has been necessary to further increase the number of source drivers to reduce the data amount that one source driver is in charge.

The present application has been made in view of the above-mentioned problem, and has an object to provide a display device capable of suppressing deterioration in signal integrity of the display data signal between the timing controller and the source driver, and capable of preventing increase the number of source drivers.

In order to solve the above-mentioned problem, according to one embodiment of the present application, there is provided a display device, including: a plurality of source drivers; and a timing controller configured to transfer display data to each of the plurality of source drivers. The plurality of source drivers include a first source driver arranged at a location close to the timing controller, and a second source driver arranged at a location farther from the timing controller with respect to the first source driver. The plurality of source drivers are each electrically connected to the timing controller via a first data transfer line, and are connected to each other via a second data transfer line. A first transfer frequency used when the display data is transferred from the timing controller to the first source driver is set higher than a second transfer frequency used when the display data is transferred from the timing controller to the second source driver. The display data includes first display data corresponding to the first source driver, and second display data corresponding to the second source driver. The timing controller is configured to transfer the first display data and part of the second display data to the first source driver via the first data transfer line at the first transfer frequency, and to transfer the remaining part of the second display data to the second source driver via the first data transfer line at the second transfer frequency. The first source driver is configured to transfer the received part of the second display data to the second source driver via the second data transfer line.

In the display device according to the one embodiment of the present application, the part of the second display data may be part of the second display data that is unable to be transferred by the timing controller to the second source driver within one horizontal period at the second transfer frequency.

In the display device according to the one embodiment of the present application, the first source driver may be configured to transfer the part of the second display data to the second source driver via the second data transfer line at the first transfer frequency.

In the display device according to the one embodiment of the present application, a transfer frequency of the display data transferred from the timing controller to the each of the plurality of source drivers may be set higher as the location at which the each of the plurality of source drivers is arranged is closer to the timing controller.

In the display device according to the one embodiment of the present application, the each of the plurality of source drivers may include a plurality of line memories, and the second source driver may be configured to store the second display data transferred from the timing controller to a first line memory, and to store the part of the second display data transferred from the first source driver to a second line memory.

Further, in order to solve the above-mentioned problem, according to one embodiment of the present application, there is provided a display device, including: a plurality of source drivers; and a timing controller configured to transfer display data to each of the plurality of source drivers. The plurality of source drivers include a first source driver, a second source driver, a third source driver, and a fourth source driver that are arranged in the stated order from a closer side to a farther side with respect to the timing controller. The plurality of source drivers are each electrically connected to the timing controller via a first data transfer line, and are cascade connected to each other via a second data transfer line. A first transfer frequency used when the display data is transferred from the timing controller to the first source driver is set higher than a second transfer frequency used when the display data is transferred from the timing controller to the second source driver. The second transfer frequency used when the display data is transferred from the timing controller to the second source driver is set higher than a third transfer frequency used when the display data is transferred from the timing controller to the third source driver. The third transfer frequency used when the display data is transferred from the timing controller to the third source driver is set higher than a fourth transfer frequency used when the display data is transferred from the timing controller to the fourth source driver. The display data includes first display data corresponding to the first source driver, second display data corresponding to the second source driver, third display data corresponding to the third source driver, and fourth display data corresponding to the fourth source driver. The timing controller is configured to, when the timing controller is unable to fully transfer the third display data to the third source driver within one horizontal period at the third transfer frequency, and when the timing controller is unable to fully transfer the fourth display data to the fourth source driver within one horizontal period at the fourth transfer frequency: transfer third untransferred data of the third display data, which corresponds to an amount that is unable to be transferred within the one horizontal period, to the second source driver via the first data transfer line together with the second display data at the second transfer frequency; and transfer fourth untransferred data of the fourth display data, which corresponds to an amount that is unable to be transferred within the one horizontal period, to the first source driver via the first data transfer line together with the first display data at the first transfer frequency. The second source driver is configured to, when the second source driver receives the third untransferred data, transfer the third untransferred data to the third source driver via the second data transfer line. The first source driver is configured to, when the first source driver receives the fourth untransferred data, transfer the fourth untransferred data to the fourth source driver via the second data transfer line.

In the display device according to the one embodiment of the present application, after the second source driver transfers the third untransferred data to the third source driver, the first source driver may transfer the fourth untransferred data to the fourth source driver.

In the display device according to the one embodiment of the present application, the second source driver may be configured to transfer the third untransferred data to the third source driver via the second data transfer line at the first transfer frequency, and the first source driver may be configured to transfer the fourth untransferred data to the fourth source driver via the second data transfer line at the first transfer frequency.

Further, in order to solve the above-mentioned problem, according to one embodiment of the present application, there is provided a display device, including: a plurality of source drivers; and a timing controller configured to transfer display data to each of the plurality of source drivers. The plurality of source drivers include a first source driver, a second source driver, a third source driver, and a fourth source driver that are arranged in the stated order from a closer side to a farther side with respect to the timing controller. The plurality of source drivers are each electrically connected to the timing controller via a first data transfer line. The first source driver and the fourth source driver are connected to each other via a second data transfer line. The second source driver and the third source driver are connected to each other via a second data transfer line. A first transfer frequency used when the display data is transferred from the timing controller to the first source driver is set higher than a second transfer frequency used when the display data is transferred from the timing controller to the second source driver. The second transfer frequency used when the display data is transferred from the timing controller to the second source driver is set higher than a third transfer frequency used when the display data is transferred from the timing controller to the third source driver. The third transfer frequency used when the display data is transferred from the timing controller to the third source driver is set higher than a fourth transfer frequency used when the display data is transferred from the timing controller to the fourth source driver. The display data includes first display data corresponding to the first source driver, second display data corresponding to the second source driver, third display data corresponding to the third source driver, and fourth display data corresponding to the fourth source driver. The timing controller is configured to, when the timing controller is unable to fully transfer the third display data to the third source driver within one horizontal period at the third transfer frequency, and when the timing controller is unable to fully transfer the fourth display data to the fourth source driver within one horizontal period at the fourth transfer frequency: transfer third untransferred data of the third display data, which corresponds to an amount that is unable to be transferred within the one horizontal period, to the second source driver via the first data transfer line together with the second display data at the second transfer frequency; and transfer fourth untransferred data of the fourth display data, which corresponds to an amount that is unable to be transferred within the one horizontal period, to the first source driver via the first data transfer line together with the first display data at the first transfer frequency. The second source driver is configured to, when the second source driver receives the third untransferred data, transfer the third untransferred data to the third source driver via the second data transfer line. The first source driver is configured to, when the first source driver receives the fourth untransferred data, transfer the fourth untransferred data to the fourth source driver via the second data transfer line.

DETAILED DESCRIPTION

An embodiment of the present application is described in the following with reference to the attached drawings. In the following, a liquid crystal display device is taken as an example, but a display device according to the present application is not limited to the liquid crystal display device, and may be, for example, an organic EL display device.

Figure 1:
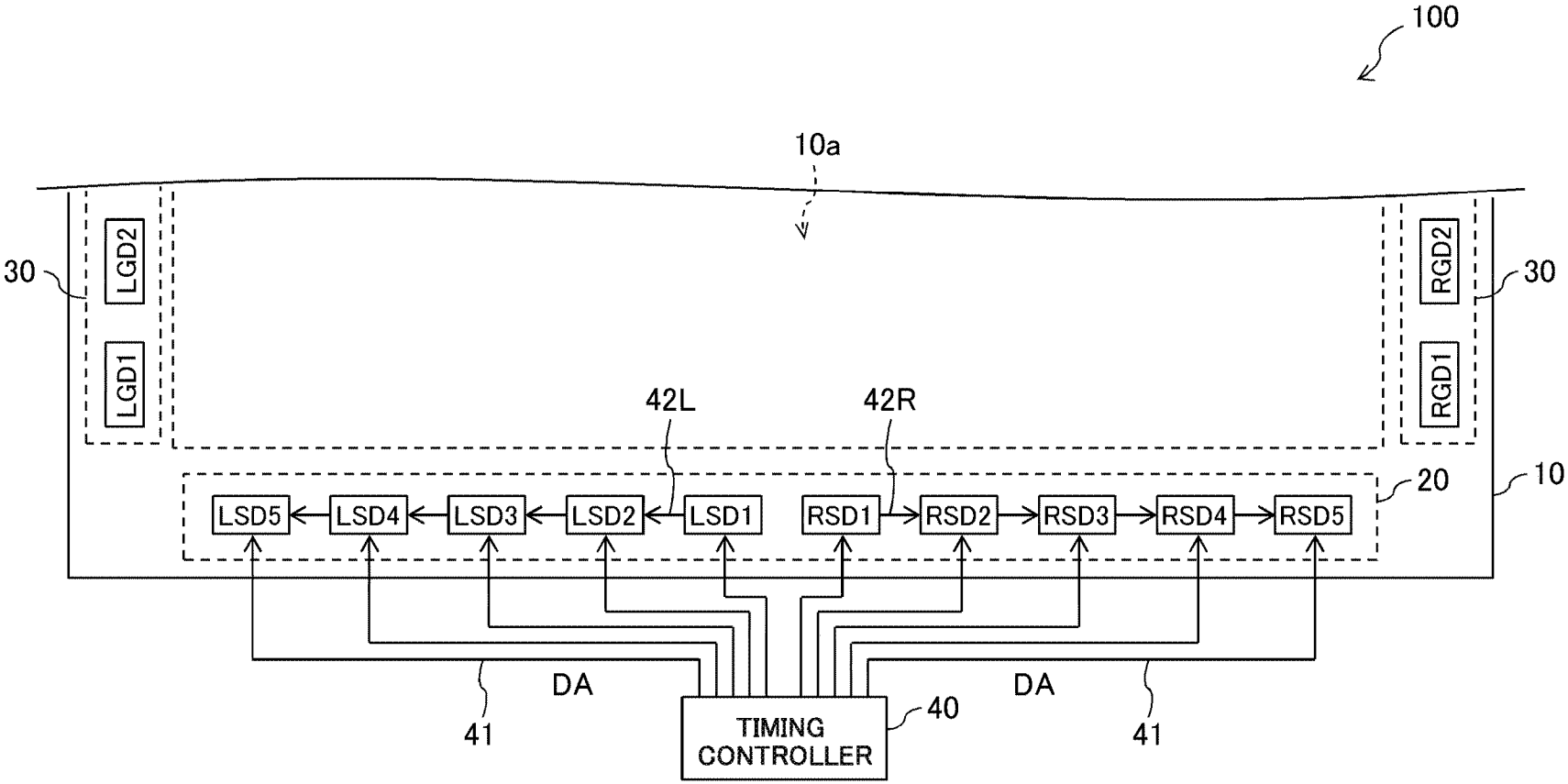
FIG. 1 is a plan view for illustrating a schematic structure of a liquid crystal display device according to an embodiment of the present application.

FIG. 1 is a plan view for illustrating a schematic structure of a liquid crystal display device according to this embodiment. A liquid crystal display device 100 includes a display panel 10, a timing controller 40, and a backlight device (not shown) arranged on a back surface side of the display panel 10 and configured to irradiate the display panel 10 with light.

Figure 2:
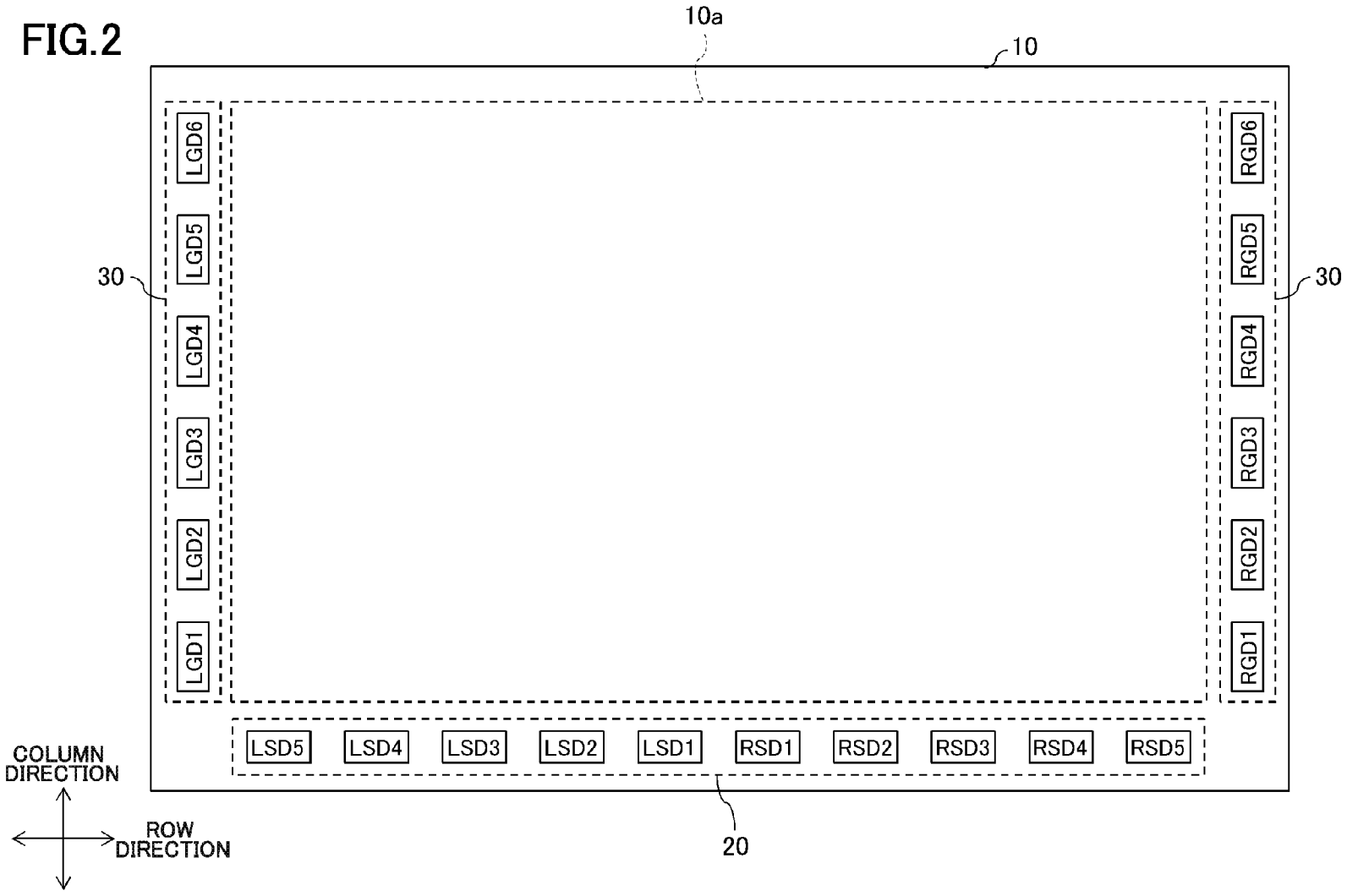
FIG. 2 is a plan view for illustrating a schematic structure of a display panel according to the embodiment.

FIG. 2 is a plan view for illustrating a schematic structure of the display panel according to this embodiment. The display panel 10 includes a plurality of source drivers 20 and a plurality of gate drivers 30. The source drivers 20 and the gate drivers 30 are formed of integrated circuits (ICs). In this embodiment, a chip on glass (COG) type display panel is described as an example, but the present application is not limited thereto, and, for example, a chip on film (COF) type display panel or a tape carrier package (TCP) type display panel may also be used.

The display panel 10 includes, for example, ten source drivers SD. Specifically, the displaypanel 10 includes five source drivers LSD1 to LSD5 arranged on a lower left side of a display region 10*a*, and five source drivers RSD1 to RSD5 arranged on a lower right side of the display region 10*a*. A predetermined number of outputs is set for each source driver SD, and a data signal (source signal) in accordance with the number of outputs is output to a corresponding data line (source line). The source drivers 20 may be arranged on an upper side of the display region 10*a*, or may be arranged both on the upper side and a lower side of the display region 10*a*.

The display panel 10 further includes, for example, twelve gate drivers GD. Specifically, the display panel 10 includes six gate drivers LGD1 to LGD6 arranged on a left side of the display region 10*a*, and gate drivers RGD1 to RGD6 arranged on a right side of the display region 10*a*. A predetermined number of outputs is set for each gate driver GD, and a gate signal (scanning signal) in accordance with the number of outputs is output to a corresponding gate line. A scanning direction of the gate lines is not limited, and the gate lines are scanned from the upper side to the lower side of the display panel 10, for example. The gate drivers 30 may be arranged on only one side of the display region 10*a*.

As illustrated in FIG. 1, each source driver SD is electrically connected to the timing controller 40 via a first data transfer line 41. The timing controller 40 is configured to transfer display data DA for image display to a main channel of each source driver SD via the first data transfer line 41. The timing controller 40 is arranged at substantially the center of the display panel 10. Therefore, the source drivers LSD1 and RSD1 are arranged at locations closest to the timing controller 40, and the source drivers LSD5 and RSD5 are arranged at locations farthest from the timing controller 40. The location where the timing controller 40 is arranged is not limited, and the timing controller 40 may be arranged, for example, on the right end side or on the left end side of the display panel 10.

Further, the timing controller 40 is configured to generate the display data DA and a plurality of timing signals for defining the operation timings of the source driver 20 and the gate driver 30. Specifically, the timing controller 40 is configured to generate the plurality of timing signals including a data start pulse, a data clock, a gate start pulse, and a gate clock based on control signals (clock signal, vertical synchronizing signal, and horizontal synchronizing signal) supplied from an external system (not shown). The timing controller 40 is configured to supply the generated plurality of timing signals to the source driver 20 and the gate driver 30, to thereby control the drives of the source driver 20 and the gate driver 30. For example, the timing controller 40 is configured to supply the data start pulse, the data clock, and the display data DA to the source driver 20. Further, the timing controller 40 is configured to supply the gate start pulse and the gate clock to the gate driver 30. The timing controller 40 may be configured to execute known image processing.

The source driver 20 is configured to output a data signal (data voltage) to the plurality of data lines based on the data start pulse, the data clock, the display data DA, and other signals transferred from the timing controller 40. In the source driver 20, sub-channels of the source drivers LSD1 to LSD5 are cascade connected via second data transfer lines 42L, and sub-channels of the source drivers RSD1 to RSD5 are cascade connected via second data transfer lines 42R.

The gate driver 30 is configured to sequentially output gate signals (scanning signals) to the plurality of gate lines based on the gate start pulse, the gate clock, and other signals transferred from the timing controller 40.

Figure 3:
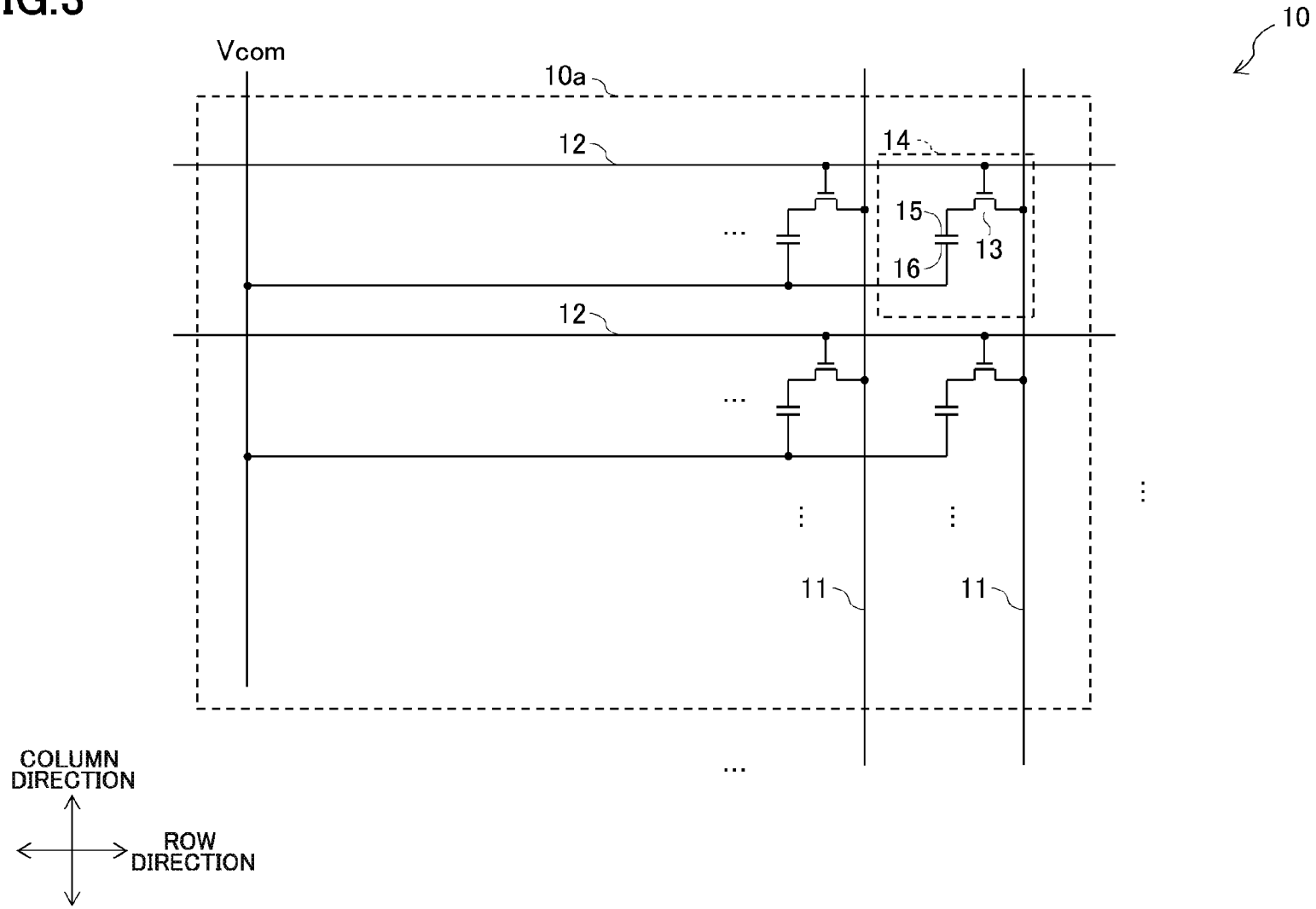
FIG. 3 is a plan view for illustrating a schematic structure of a display region in the display panel.

FIG. 3 is a plan view for illustrating a schematic structure of the display region 10*a* in the display panel 10. The display region 10*a* includes a plurality of data lines 11 that extend in a column direction and a plurality of gate lines 12 that extend in a row direction. The data lines 11 are electrically connected to the corresponding source drivers SD, respectively, and the gate lines 12 are electrically connected to the corresponding gate drivers GD, respectively, outside the display region 10*a*. A thin film transistor 13 (TFT) is formed in an intersecting portion of a data line 11 and a gate line 12. A plurality of pixels 14 are arranged in the display panel 10 in matrix (in the row direction and in the column direction) correspondingly to the intersecting portions, respectively, of the data lines 11 and the gate lines 12. Note that, although not shown, the display panel 10 includes a thin film transistor substrate (TFT substrate), a color filter substrate (CF substrate), and a liquid crystal layer sandwiched between the substrates. A plurality of pixel electrodes 15 corresponding to the pixels 14, respectively, and a common electrode 16 common to the pixels 14 are formed on the TFT substrate. The common electrode 16 may be formed on the CF substrate.

A data signal (data voltage) is supplied to each data line 11 from a corresponding source driver SD. A gate signal (gate voltage) is supplied to each gate line 12 from a corresponding gate driver GD. A common voltage Vcom is supplied to the common electrode 16 from a common driver (not shown). When an ON voltage of a gate signal (gate ON voltage) is supplied to a gate line 12, a thin film transistor 13 connected to the gate line 12 is turned on, and the data voltage is supplied to a pixel electrode 15 via a data line 11 connected to the thin film transistor 13. An electric field is generated due to a difference between the data voltage supplied to the pixel electrode 15 and the common voltage Vcom supplied to the common electrode 16. The electric field drives the liquid crystal to control transmittance of light emitted from the backlight device, thereby displaying an image. Note that, when color display is performed, the display is realized by supplying a desired data voltage to each data line 11 connected to pixel electrodes 15 of pixels 14 corresponding to red, green, blue, and the like formed with stripe-like color filters.

Figure 4:
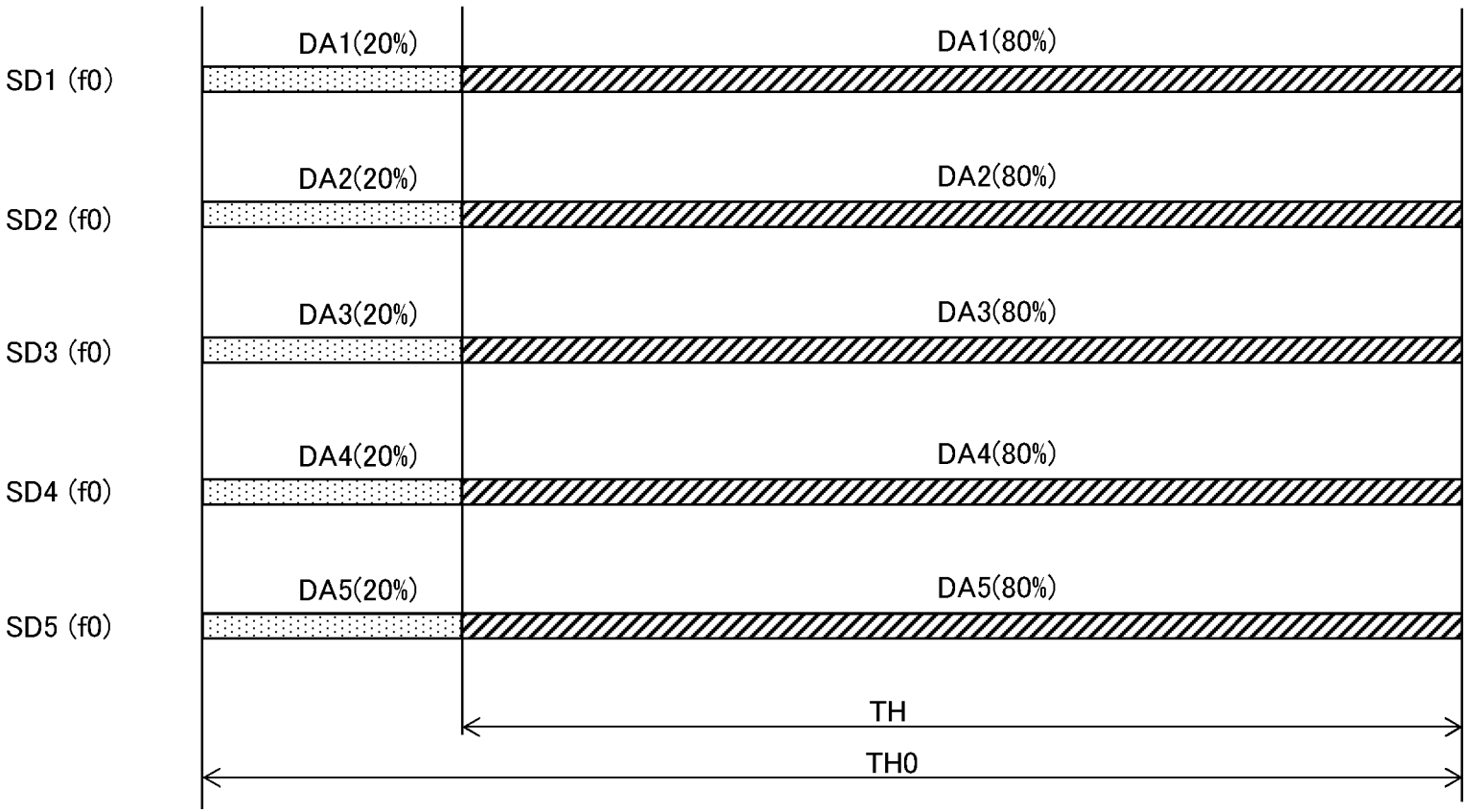
FIG. 4 is a schematic diagram for illustrating a method of transferring display data according to a comparative example.
Figure 5:
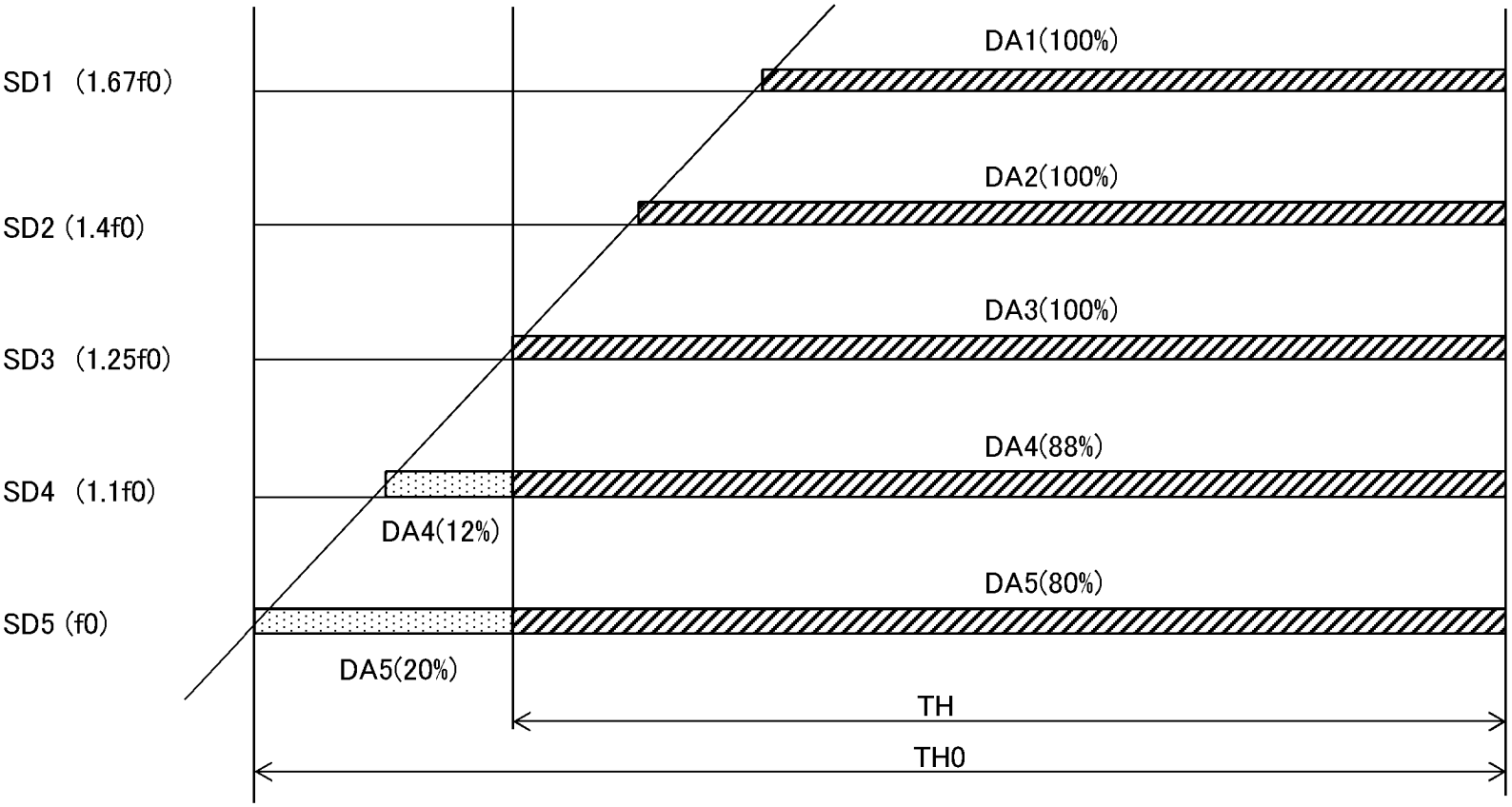
FIG. 5 is a schematic diagram for illustrating a method of transferring display data according to the embodiment.
Figure 6:
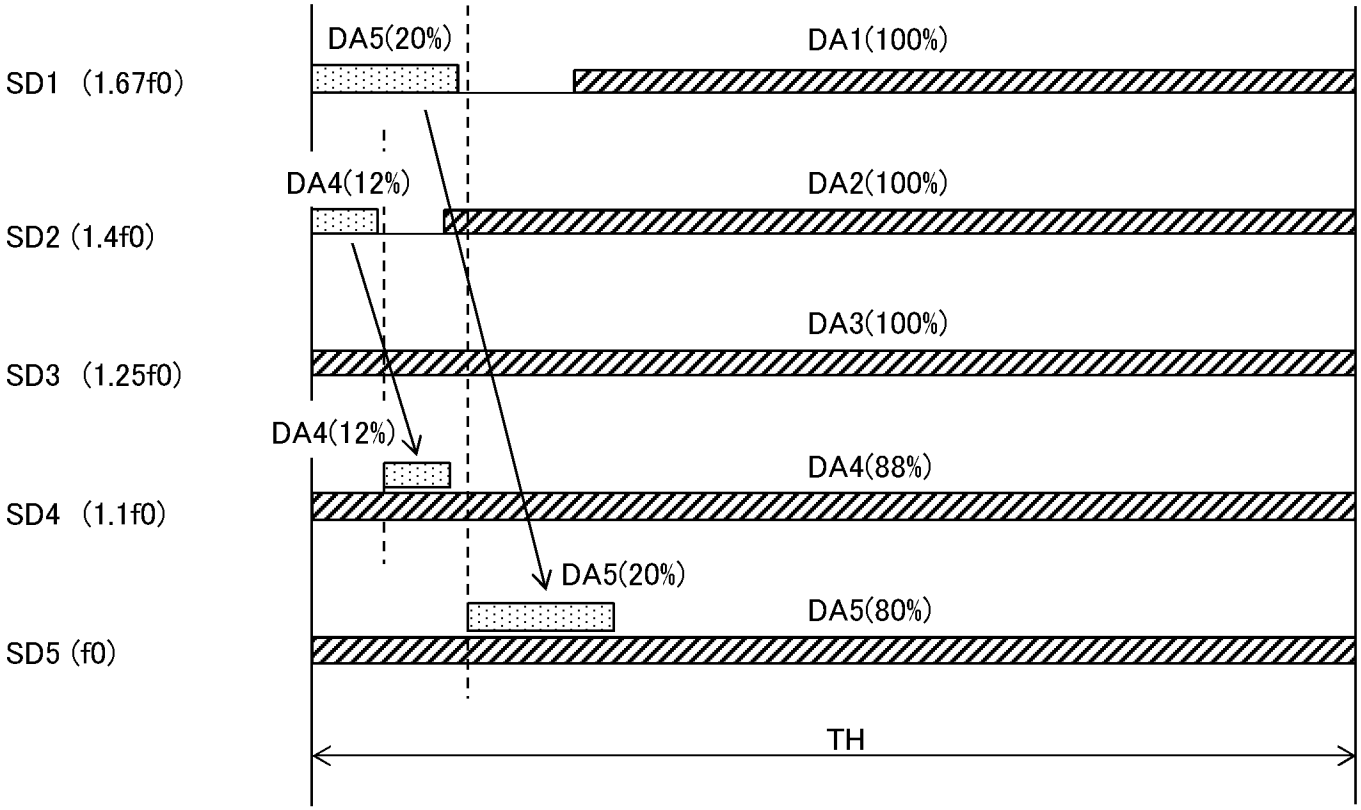
FIG. 6 is a schematic diagram for illustrating the method of transferring display data according to the embodiment.

Now, an example of a method of transferring the display data DA to the source driver 20 by the timing controller 40 is described. FIG. 4 is a schematic diagram for illustrating the method of transferring the display data DA according to a comparative example. FIG. 5 and FIG. 6 are schematic diagrams for illustrating the method of transferring the display data DA according to this embodiment.

In FIG. 4, FIG. 5, and FIG. 6, there are illustrated the source driver SD1 arranged closest to the timing controller 40, and the source drivers SD2, SD3, SD4, and SD5 arranged in order in a direction of being away from the timing controller 40. The source drivers SD1 to SD5 of FIG. 4, FIG. 5, and FIG. 6 correspond to the source drivers LSD1 to LSD5 or the source drivers RSD1 to RSD5 of FIG. 1.

In FIG. 4, a transfer frequency that can be used in the source driver SD5 arranged at the farthest end is assumed to be a transfer frequency f0. When the display data DA is transferred to each of the source drivers SD1 to SD5 uniformly at the transfer frequency f0, the display data DA may not be fully transferred by each of the source drivers SD1 to SD5 within a determined horizontal period (TH). In the example of FIG. 4, each of the source drivers SD1 to SD5 cannot transfer display data corresponding to 20% of the display data DA. In the following, display data of the display data DA corresponding to an amount that cannot be transferred within one horizontal period is also referred to as "untransferred data".

In contrast, in the display device 100 according to this embodiment, as illustrated in FIG. 5, the data transfer speed between the timing controller 40 and each of the source drivers SD1 to SD5 is set to be faster as the source driver is closer to the timing controller 40. With this, the source driver SD closer to the timing controller 40 has time to spare in data transfer. In view of this, the transfer frequency used when the display data DA is transferred from the timing controller 40 to each of the source drivers SD1 to SD5 is set to be higher as the source driver is closer to the timing controller 40. For example, when the transfer frequency for the source driver SD5 is set to f0, the transfer frequency for the source driver SD4 is set to 1.1 times as high as f0 (1.1f0), the transfer frequency for the source driver SD3 is set to 1.25 times as high as f0 (1.25f0), the transfer frequency for the source driver SD2 is set to 1.4 times as high as f0 (1.4f0), and the transfer frequency for the source driver SD1 is set to 1.67 times as high as f0 (1.67f0). In this case, it is assumed that, when the transfer frequency is 1.25f0, the display data DA can be exactly transferred within one horizontal period (TH).

Further, when the transfer frequencies are set as described above, in the source driver SD4, display data corresponding to 12% of display data DA4 becomes untransferred data, and in the source driver SD5, display data corresponding to 20% of display data DA5 becomes untransferred data. Note that, a ratio of the data amount of the untransferred data to the display data DA can be obtained by (THn−TH)/THn=1−TH/THn=1−fn/fa. Symbol fa represents a transfer frequency at which the display data DA can be exactly transferred in one horizontal period (TH), and symbol fn represents an actually-used transfer frequency.

In view of this, in the display device 100 according to this embodiment, the timing controller 40 is configured to transfer the untransferred data DA to the source driver SD having time to spare in data transfer. For example, as illustrated in FIG. 6, the timing controller 40 is configured to transfer display data DA1 and untransferred data DA5 corresponding to 20% of the display data DA5 to the source driver SD1. Further, the timing controller 40 is configured to transfer display data DA2 and untransferred data DA4 corresponding to 12% of the display data DA4 to the source driver SD2. Note that, the transfer frequencies 1.67f0 and 1.4f0 for the source drivers SD1 and SD2 are higher than the transfer frequencies f0 and 1.1f0 for the source drivers SD5 and SD4, respectively, and hence the time required for the timing controller 40 to transfer the untransferred data to the source drivers SD1 and SD2 is shorter than the time required for the timing controller 40 to transfer the untransferred data to the source drivers SD5 and SD4.

Further, the source driver SD that has received the untransferred data DA transfers the untransferred data DA to the corresponding source driver SD via the second data transfer line 42 (see FIG. 1) connecting between the sub-channels of the source drivers SD. For example, as illustrated in FIG. 6, the source driver SD1 transfers the untransferred data DA5 corresponding to 20% of the display data DA5 to the source driver SD5 via the second data transfer line 42. Further, the source driver SD2 transfers the untransferred data DA4 corresponding to 12% of the display data DA4 to the source driver SD4 via the second data transfer line 42.

For example, information on an address of the untransferred data DA5 (for example, identification information of the source driver SD5) is inserted into a control code on the main channel of the source driver SD1, and after the source driver SD1 completes importing of the untransferred data DA5, the source driver SD1 uses the sub-channel to send the untransferred data DA5 and the above-mentioned information. With this, after the untransferred data DA4 is transferred from the source driver SD2 to the source driver SD4, the untransferred data DA5 is transferred from the source driver SD1 to the source driver SD5. Note that, the data transfer by the sub-channel is short in transfer distance, and a transmission signal is buffered by the source driver SD. Therefore, the transfer frequency of the display data DA1 transferred to the main channel of the source driver SD1 at the closest end can be used to uniformly perform peer-to-peer (P2P) transfer.

In the above-mentioned data transfer method, the data transfer speed is set to be slow in the source driver SD arranged at a location far from the timing controller 40, and the data transfer speed is set to be fast in the source driver SD arranged at a location close to the timing controller 40. Therefore, in the source driver SD arranged at a location far from the timing controller 40, deterioration in signal integrity of a display data signal can be suppressed. Further, the source driver SD arranged at a location close to the timing controller 40 has time to spare in data transfer. In view of this, this source driver SD imports the display data (untransferred data DA) that cannot be transferred due to the decreased data transfer speed, and transfers the untransferred data DA to the corresponding source driver SD. High-speed transfer is possible in data transfer between the source drivers SD, and hence the untransferred data DA can be reliably transferred to the corresponding source driver SD. That is, without lowering the transfer rate of the display data DA or increasing the number of source drivers SD, the timing controller 40 can transfer the display data DA to the source drivers SD.

Figure 7:
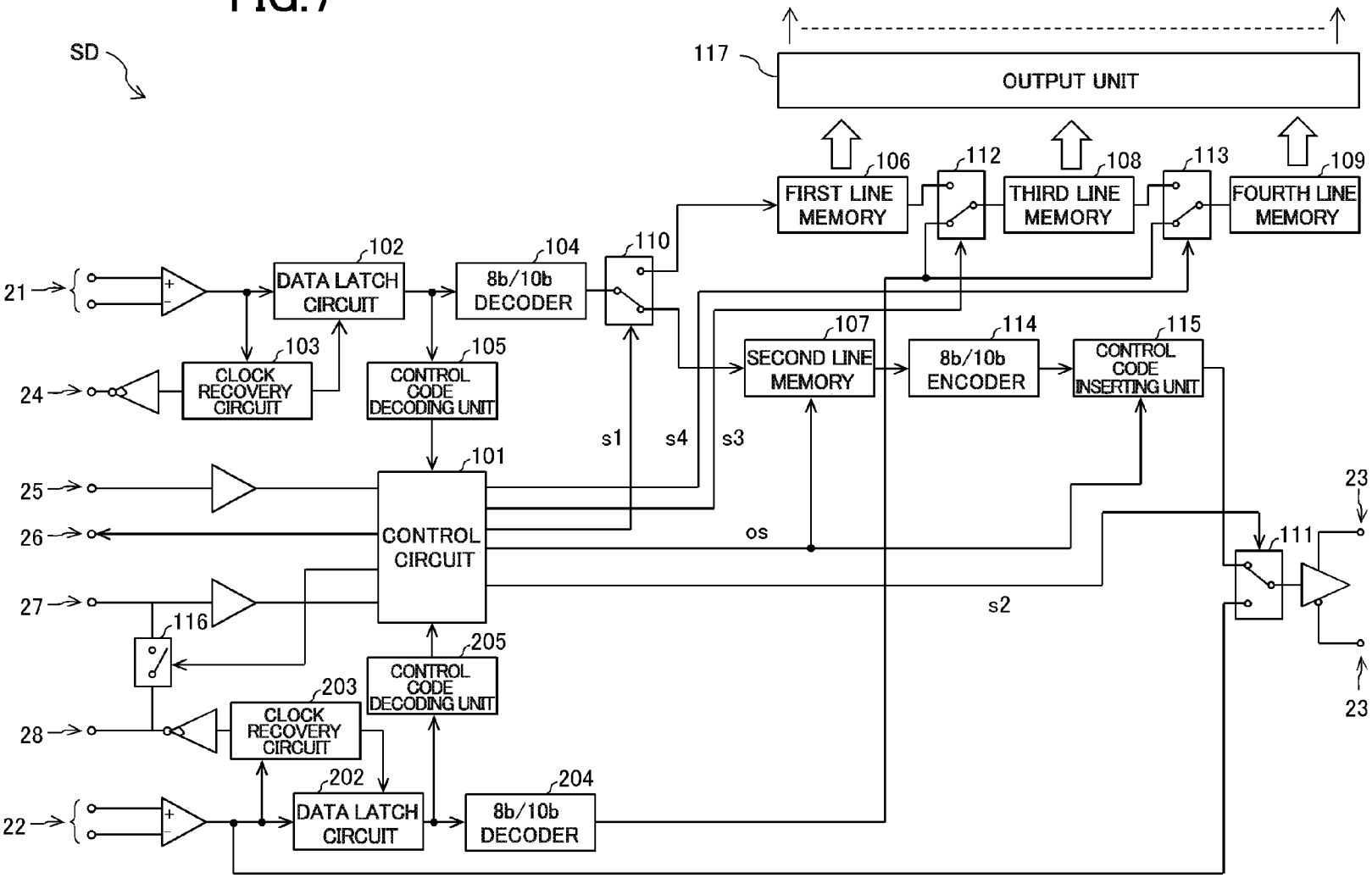
FIG. 7 is a block diagram for illustrating a specific structure of a source driver according to the embodiment.

Next, the specific structure of the source driver SD for realizing the above-mentioned method of transferring the display data DA is described. FIG. 7 is a block diagram for illustrating the specific structure of the source driver SD according to this embodiment. The source drivers LSD1 to LSD5 and RSD1 to RSD5 of FIG. 1 each have the structure illustrated in FIG. 7.

The source driver SD includes a control circuit 101, data latch circuits 102 and 202, clock recovery circuits 103 and 203, **8*b*/10*b* decoders 104 and 204, control code decoding units 105 and 205, a first line memory 106, a second line memory 107, a third line memory 108, a fourth line memory 109, a first selector 110, a second selector 111, a third selector 112, a fourth selector 113, an 8*b*/10*b* encoder 114, a control code inserting unit 115, a switch unit 116, and an output unit 117. The source driver SD further includes a plurality of channels including a main channel input portion 21, a sub-channel input portion 22, and a sub-channel output portion 23**.

The display data DA being differential signals is input from the timing controller 40 to the main channel input portion 21 of the source driver SD. Note that, although not shown, a differential input is terminated with a terminating resistor or the like. When the transfer of the display data DA is started, a synchronizing signal is input to recover a clock in the clock recovery circuit 103 including a PLL circuit. At a time point when the clock is synchronized, an output of a /LOCK OUT1 terminal 24 is in an open state. The /LOCK OUT1 terminal 24 is wired-OR connected to a /LOCK OUT1 terminal of each source driver SD. At a time point when the clocks of all of the source drivers SD are synchronized, the timing controller 40 sends the display data DA including the control code. The control code is decoded by the control code decoding unit 105. For example, the control code is a code representing presence or absence of display data to be transferred to another source driver SD with use of the sub-channel (hereinafter also referred to as "sub-channel data"), the address of the transfer destination of the sub-channel data, the end of the sub-channel data, and the start and end of the display data DA to be processed by the source driver SD. The control code further includes a code relating to setting information of the source driver SD and other control information.

As in the source driver SD1 illustrated in FIG. 6, when the sub-channel data (untransferred data DA5) is received from the timing controller 40, with use of the first selector 110, the sub-channel data is stored in the second line memory 107 via the 8*b*/10*b* decoder 104, and the display data DA1 of the source driver SD1 is stored in the first line memory 106, the third line memory 108, and the fourth line memory 109. The switching operation of the first selector 110 is performed based on a selection signal s1 output from the control circuit 101. At this time, the third selector 112 and the fourth selector 113 select the output terminals of the first line memory 106 and the third line memory 108, respectively, based on selection signals s3 and s4 output from the control circuit 101. With this, the display data DA1 of the source driver SD1 is stored in the first line memory 106, the third line memory 108, and the fourth line memory 109. The output of the second line memory 107 is guided to the sub-channel output portion 23 via the 8*b*/10*b* encoder 114, the control code inserting unit 115, and the second selector 111. The sub-channel data is actually output only when the sub-channel data is stored in the second line memory 107, and when an input signal of a /Busy In terminal 25 is High, that is, when the source driver SD in a higher order than the source driver SD1 (lower in transfer frequency) does not use the sub-channel. Although not shown, a terminating resistor is connected to the differential input of the sub-channel, and an output resistor that is matched with the line impedance is connected to the output.

When the source driver SD uses the sub-channel, a signal of a /Busy Out terminal 26 is dropped to Low so as to notify the source driver SD in a lower order (higher in transfer frequency) of inhibition of the use of the sub-channel. The end of storage of the sub-channel data starts from the source driver SD in a higher order. At this time, a data sending start signal os is input from the control circuit 101 to the second line memory 107 and the control code inserting unit 115. Further, when a selection signal s2 is input from the control circuit 101 to the second selector 111, the input terminal of the sub-channel output portion 23 is connected to the output terminal of the control code inserting unit 115.

On the other hand, in the source driver SD that does not have the sub-channel data, the input terminal of the second selector 111 is connected to the sub-channel input portion 22 so that the sub-channel data is bypassed to the source driver SD in the higher order. The sub-channel data is buffered at the sub-channel output portion 23 to be transferred to the source driver SD in the higher order. After the source driver SD sends a synchronizing signal and confirms that a signal of a /LOCK In terminal 27 becomes High, the source driver SD sends the control code and the display data DA. All of the source drivers SD in a higher order than this source driver SD perform a synchronous operation to set a signal of a /LOCK Out2 terminal 28 to High. At this time, the source drivers SD in a lower order than this source driver SD do not perform the synchronous operation, and hence the signal of the /LOCK Out2 terminal 28 is held Low. Therefore, the switch unit 116 is turned off to eliminate the influence.

On the other hand, all of the higher-order source drivers SD that have received the sub-channel data at the sub-channels each decode the control code to determine whether or not the display data is transferred thereto. For example, in the source driver SD5, the decoded sub-channel data (untransferred data DA5) is stored in the third line memory 108 and the fourth line memory 109 via the third selector 112 and the fourth selector 113. In parallel therewith, the display data DA5 input from the main channel input portion 21 is stored in the first line memory 106. Further, in the source driver 5D4, the decoded sub-channel data (untransferred data DA4) is stored in the fourth line memory 109 via the fourth selector 113. In parallel therewith, the display data DA4 input from the main channel input portion 21 is stored in the first line memory 106 and the third line memory 108. This operation is set by the control code on the main channel.

After the display data DA and the sub-channel data are stored in the respective line memories, the display data DA and the sub-channel data are transferred to the output unit 117. The output unit 117 outputs, to the corresponding data line 11, the display data DA for one line including the display data DA and the sub-channel data based on a predetermined timing. A known structure can be employed to the structure of the output unit 117.

The structure of the source driver SD according to this embodiment is not limited to the structure illustrated in FIG. 7. Further, the above-mentioned line memories are not limited to the above-mentioned structure. Data input and a clock of a D-type flip-flop (DFF) forming the line memory may be controlled so that the data from the main channel and the data from the sub-channel can be simultaneously written with one line memory.

Figure 8:
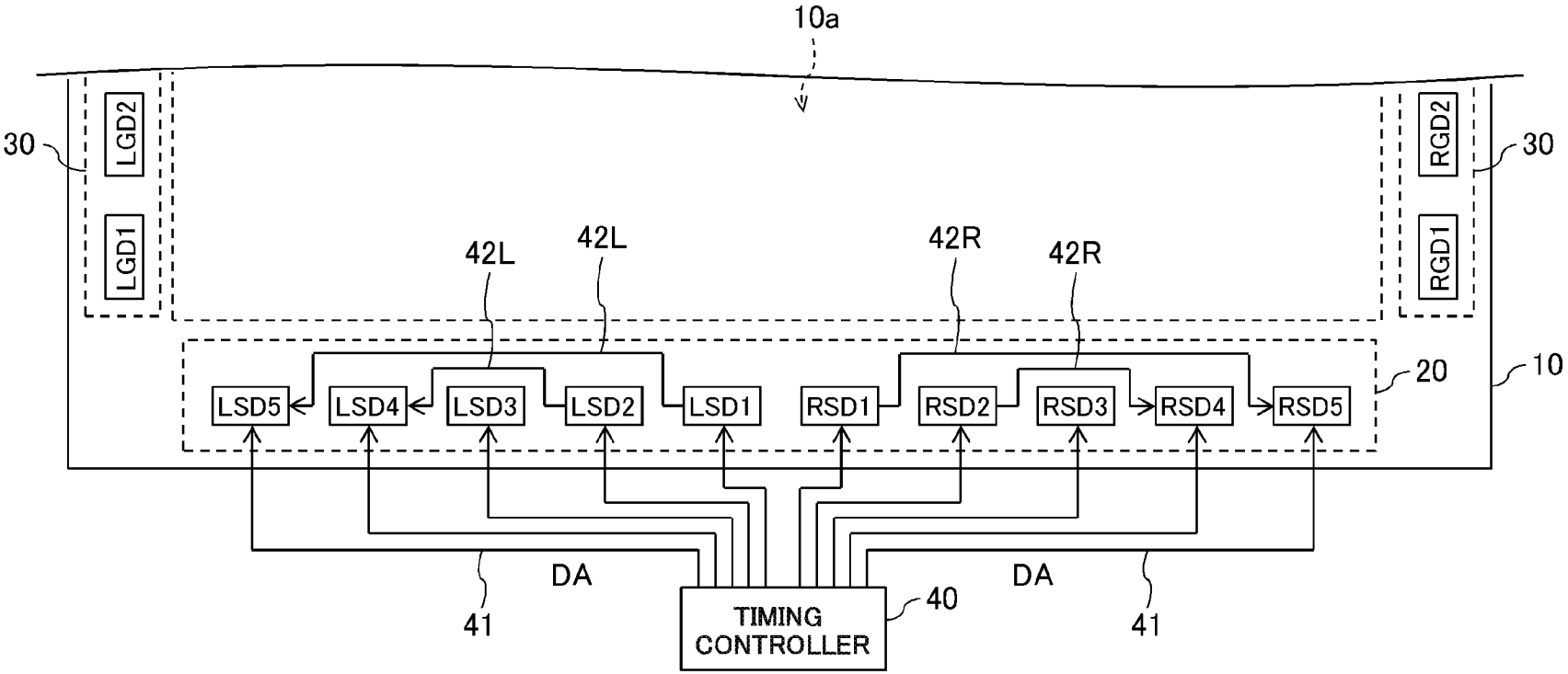
FIG. 8 is a plan view for illustrating another structure of the liquid crystal display device according to the embodiment.

The connection structure between the source drivers SD according to this embodiment is not limited to the structure illustrated in FIG. 1. For example, as illustrated in FIG. 8, the source driver LSD1 and the source driver LSD5 may be connected to each other via a second data transfer line 42L, and the source driver LSD2 and the source driver LSD4 may be connected to each other via a second data transfer line 42L. Similarly, the source driver RSD1 and the source driver RSD5 may be connected to each other via a second data transfer line 42R, and the source driver RSD2 and the source driver RSD4 may be connected to each other via a second data transfer line 42R. In the above-mentioned structure, as illustrated in FIG. 6, the timing controller 40 is configured to transfer the display data DA1 and the untransferred data DA5 of the display data DA5 to the source driver SD1. Further, the timing controller 40 is configured to transfer the display data DA2 and the untransferred data DA4 of the display data DA4 to the source driver SD2. Further, the source driver SD1 is configured to transfer the untransferred data DA5 directly to the source driver SD5 via the second data transfer line 42. Further, the source driver SD2 is configured to transfer the untransferred data DA4 directly to the source driver SD4 via the second data transfer line 42. With the above-mentioned structure, the untransferred data DA5 can be directly transferred from the source driver SD1 to the source driver SD5, and the untransferred data DA4 can be directly transferred from the source driver SD2 to the source driver SD4. Therefore, the transfer processing can be simplified as compared to the structure of FIG. 1.

Further, the liquid crystal display device 100 according to this embodiment may have the following structure. It is assumed that the first transfer frequency used when the display data is transferred from the timing controller 40 to the first source driver SD is set to be higher than the second transfer frequency used when the display data is transferred from the timing controller 40 to the second source driver SD, and that the display data includes first display data corresponding to the first source driver SD and second display data corresponding to the second source driver SD. In this case, the timing controller 40 may be configured to transfer part of the second display data to the first source driver SD via the first data transfer line 41 together with the first display data at the first transfer frequency, and to transfer the remaining part of the second display data to the second source driver SD via the first data transfer line 41 at the second transfer frequency. Further, the first source driver SD may be configured to transfer the received part of the second display data to the second source driver SD via the second data transfer line 42. Note that, the above-mentioned part of the second display data is not limited to the above-mentioned untransferred data, and may be part of the second display data that can be transferred to the corresponding source driver SD within the one horizontal period at the second transfer frequency. With the above-mentioned structure, the direct transfer between the timing controller 40 and the source driver SD and the P2P transfer between the source drivers SD can be both performed. Thus, the efficiency of the transfer processing can be increased. Note that, the first display data corresponding to the first source driver SD refers to data output from the first source driver SD so as to display an image on a display unit of the display panel 10, and the second display data corresponding to the second source driver SD refers to data output from the second source driver SD so as to display an image on the display unit of the display panel 10.

While there have been described what are at present considered to be certain embodiments of the application, it will be understood that various modifications may be made thereto, and it is intended that the appended claims cover all such modifications as fall within the true spirit and scope of the invention.

What is claimed is:

1. A display device, comprising:

a plurality of source drivers; and a timing controller configured to transfer display data to each of the plurality of source drivers, wherein the plurality of source drivers comprise a first source driver arranged at a location close to the timing controller, and a second source driver arranged at a location farther from the timing controller with respect to the first source driver, wherein the plurality of source drivers are each electrically connected to the timing controller via a first data transfer line, and are connected to each other via a second data transfer line, wherein a first transfer frequency used when the display data is transferred from the timing controller to the first source driver is set higher than a second transfer frequency used when the display data is transferred from the timing controller to the second source driver, wherein the display data comprises first display data corresponding to the first source driver, and second display data corresponding to the second source driver, wherein the timing controller is configured to transfer the first display data and part of the second display data to the first source driver via the first data transfer line at the first transfer frequency, and to transfer the remaining part of the second display data to the second source driver via the first data transfer line at the second transfer frequency, and wherein the first source driver is configured to transfer the received part of the second display data to the second source driver via the second data transfer line.

2. The display device according to claim 1, wherein the part of the second display data is part of the second display data that is unable to be transferred by the timing controller to the second source driver within one horizontal period at the second transfer frequency.

3. The display device according to claim 1, wherein the first source driver is configured to transfer the part of the second display data to the second source driver via the second data transfer line at the first transfer frequency.

4. The display device according to claim 1, wherein a transfer frequency of the display data transferred from the timing controller to the each of the plurality of source drivers is set higher as the location at which the each of the plurality of source drivers is arranged is closer to the timing controller.

5. The display device according to claim 1, wherein the each of the plurality of source drivers comprises a plurality of line memories, and wherein the second source driver is configured to store the second display data transferred from the timing controller to a first line memory, and to store the part of the second display data transferred from the first source driver to a second line memory.

6. A display device, comprising:

a plurality of source drivers; and a timing controller configured to transfer display data to each of the plurality of source drivers, wherein the plurality of source drivers comprise a first source driver, a second source driver, a third source driver, and a fourth source driver that are arranged in the stated order from a closer side to a farther side with respect to the timing controller, wherein the plurality of source drivers are each electrically connected to the timing controller via a first data transfer line, and are cascade connected to each other via a second data transfer line, wherein a first transfer frequency used when the display data is transferred from the timing controller to the first source driver is set higher than a second transfer frequency used when the display data is transferred from the timing controller to the second source driver, wherein the second transfer frequency used when the display data is transferred from the timing controller to the second source driver is set higher than a third transfer frequency used when the display data is transferred from the timing controller to the third source driver, wherein the third transfer frequency used when the display data is transferred from the timing controller to the third source driver is set higher than a fourth transfer frequency used when the display data is transferred from the timing controller to the fourth source driver, wherein the display data comprises first display data corresponding to the first source driver, second display data corresponding to the second source driver, third display data corresponding to the third source driver, and fourth display data corresponding to the fourth source driver, wherein the timing controller is configured to, when the timing controller is unable to fully transfer the third display data to the third source driver within one horizontal period at the third transfer frequency, and when the timing controller is unable to fully transfer the fourth display data to the fourth source driver within one horizontal period at the fourth transfer frequency:

transfer third untransferred data of the third display data, which corresponds to an amount that is unable to be transferred within the one horizontal period, to the second source driver via the first data transfer line together with the second display data at the second transfer frequency; and transfer fourth untransferred data of the fourth display data, which corresponds to an amount that is unable to be transferred within the one horizontal period, to the first source driver via the first data transfer line together with the first display data at the first transfer frequency, wherein the second source driver is configured to, when the second source driver receives the third untransferred data, transfer the third untransferred data to the third source driver via the second data transfer line, and wherein the first source driver is configured to, when the first source driver receives the fourth untransferred data, transfer the fourth untransferred data to the fourth source driver via the second data transfer line.

7. The display device according to claim 6, wherein, after the second source driver transfers the third untransferred data to the third source driver, the first source driver transfers the fourth untransferred data to the fourth source driver.

8. The display device according to claim 6, wherein the second source driver is configured to transfer the third untransferred data to the third source driver via the second data transfer line at the first transfer frequency, and wherein the first source driver is configured to transfer the fourth untransferred data to the fourth source driver via the second data transfer line at the first transfer frequency.

9. A display device, comprising:

a plurality of source drivers; and a timing controller configured to transfer display data to each of the plurality of source drivers, wherein the plurality of source drivers comprise a first source driver, a second source driver, a third source driver, and a fourth source driver that are arranged in the stated order from a closer side to a farther side with respect to the timing controller, wherein the plurality of source drivers are each electrically connected to the timing controller via a first data transfer line, wherein the first source driver and the fourth source driver are connected to each other via a second data transfer line, wherein the second source driver and the third source driver are connected to each other via a second data transfer line, wherein a first transfer frequency used when the display data is transferred from the timing controller to the first source driver is set higher than a second transfer frequency used when the display data is transferred from the timing controller to the second source driver, wherein the second transfer frequency used when the display data is transferred from the timing controller to the second source driver is set higher than a third transfer frequency used when the display data is transferred from the timing controller to the third source driver, wherein the third transfer frequency used when the display data is transferred from the timing controller to the third source driver is set higher than a fourth transfer frequency used when the display data is transferred from the timing controller to the fourth source driver, wherein the display data comprises first display data corresponding to the first source driver, second display data corresponding to the second source driver, third display data corresponding to the third source driver, and fourth display data corresponding to the fourth source driver, wherein the timing controller is configured to, when the timing controller is unable to fully transfer the third display data to the third source driver within one horizontal period at the third transfer frequency, and when the timing controller is unable to fully transfer the fourth display data to the fourth source driver within one horizontal period at the fourth transfer frequency:

transfer third untransferred data of the third display data, which corresponds to an amount that is unable to be transferred within the one horizontal period, to the second source driver via the first data transfer line together with the second display data at the second transfer frequency; and transfer fourth untransferred data of the fourth display data, which corresponds to an amount that is unable to be transferred within the one horizontal period, to the first source driver via the first data transfer line together with the first display data at the first transfer frequency, wherein the second source driver is configured to, when the second source driver receives the third untransferred data, transfer the third untransferred data to the third source driver via the second data transfer line, and wherein the first source driver is configured to, when the first source driver receives the fourth untransferred data, transfer the fourth untransferred data to the fourth source driver via the second data transfer line.

* * * * *